US009456265B2

(12) United States Patent
Park et al.

(10) Patent No.: US 9,456,265 B2
(45) Date of Patent: Sep. 27, 2016

(54) ELECTRONIC DEVICE AND CONTROL METHOD THEREOF

(71) Applicant: LG ELECTRONICS INC., Seoul (KR)

(72) Inventors: Yonghahk Park, Seoul (KR); Gail Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 96 days.

(21) Appl. No.: 14/341,527

(22) Filed: Jul. 25, 2014

(65) Prior Publication Data

US 2015/0063587 A1 Mar. 5, 2015

(30) Foreign Application Priority Data

Sep. 5, 2013 (KR) ..... 10-2013-0106701

(51) Int. Cl.
*H04R 1/10* (2006.01)

(52) U.S. Cl.
CPC ..... *H04R 1/1016* (2013.01); *H04R 2420/05* (2013.01); *H04R 2499/11* (2013.01)

(58) Field of Classification Search
CPC H04R 5/003; H04R 1/1041; H04R 2420/07; H04R 5/04; H04R 1/1016
See application file for complete search history.

(56) References Cited

U.S. PATENT DOCUMENTS 4,845,751 A * 7/1989 Schwab ..... H04H 20/88 381/105
5,794,127 A * 8/1998 Lansang ..... H04R 1/1041 340/12.5
9,037,277 B1 * 5/2015 Sperring ..... H04M 1/6058 700/94
2005/0277446 A1 * 12/2005 Yueh ..... H04W 88/02 455/569.1
2007/0293287 A1 * 12/2007 Yu ..... H04M 1/6066 455/575.2
2009/0287327 A1 * 11/2009 Hsu ..... H04R 1/1091 700/94
2010/0128887 A1 * 5/2010 Lee ..... H04R 1/1041 381/74
2010/0142719 A1 * 6/2010 Chiba ..... H04R 1/1016 381/71.6
2010/0197360 A1 * 8/2010 Namgoong ..... H04M 1/6058 455/569.1
2013/0216060 A1 * 8/2013 Narayan ..... H04R 3/005 381/71.6

* cited by examiner

*Primary Examiner* — Simon Sing
(74) *Attorney, Agent, or Firm* — Ked & Associates, LLP

(57) ABSTRACT

Disclosed are an electronic device and a method for controlling the same. The electronic device includes: a signal detection module configured to acquire an electric signal from an earphone plug; and a controller is configured to acquire the electric signal through the signal detection module, to detect magnitude of the acquired electric signal, to determine whether an earphone is worn by comparing a variation amount in the magnitude of the electric signal with a reference value, and to control an output operation of a sound according to whether the earphone is worn.

18 Claims, 13 Drawing Sheets

ELECTRONIC DEVICE AND CONTROL METHOD THEREOF

CROSS-REFERENCE TO RELATED APPLICATIONS

Pursuant to 35 U.S.C. §119(a), this application claims the benefit of earlier filing date and right of priority to Korean Patent Application No. 10-2013-0106701, filed on Sep. 5, 2013, the contents of which are incorporated by reference herein in their entirety.

BACKGROUND

1. Field

The present disclosure relates to an electronic device to detect whether an earphone is being worn by a user and a method for controlling the same.

2. Background

In recent years, an electronic device such as a smart phone has provided various multi-media services such as data communication, a camera, a DMB, playback of a moving image, a short message service (SMS), and schedule management as well as a voice call function.

Among the above multi-media services, an audio output function separately includes a MIDI speaker and plays a bell sound and a moving image through the MIDI speaker to improve quality of a sound.

Since sound quality in an audio output through a speaker is degraded and the output audio damages other users, a case of using an ear phone is increased. In a case of a user often listening to the audio, the earphone is generally inserted into the electronic device.

However, when a telephone is received in a state that the user wears the earphone, since a bell sound is output through the earphone, the user may immediately recognize reception for the telephone. However, when the user does not wear the earphone in a state that the earphone is inserted into the electronic device, because a bell sound output through the earphone is small, the user cannot easily recognize presence of reception for the telephone.

Accordingly, when the earphone is used in a state that the earphone is inserted into the electronic device, the user needs to recognize whether to wear the earphone and to output the audio in a method that the user easily recognizes.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

DETAILED DESCRIPTION

Figure 1:
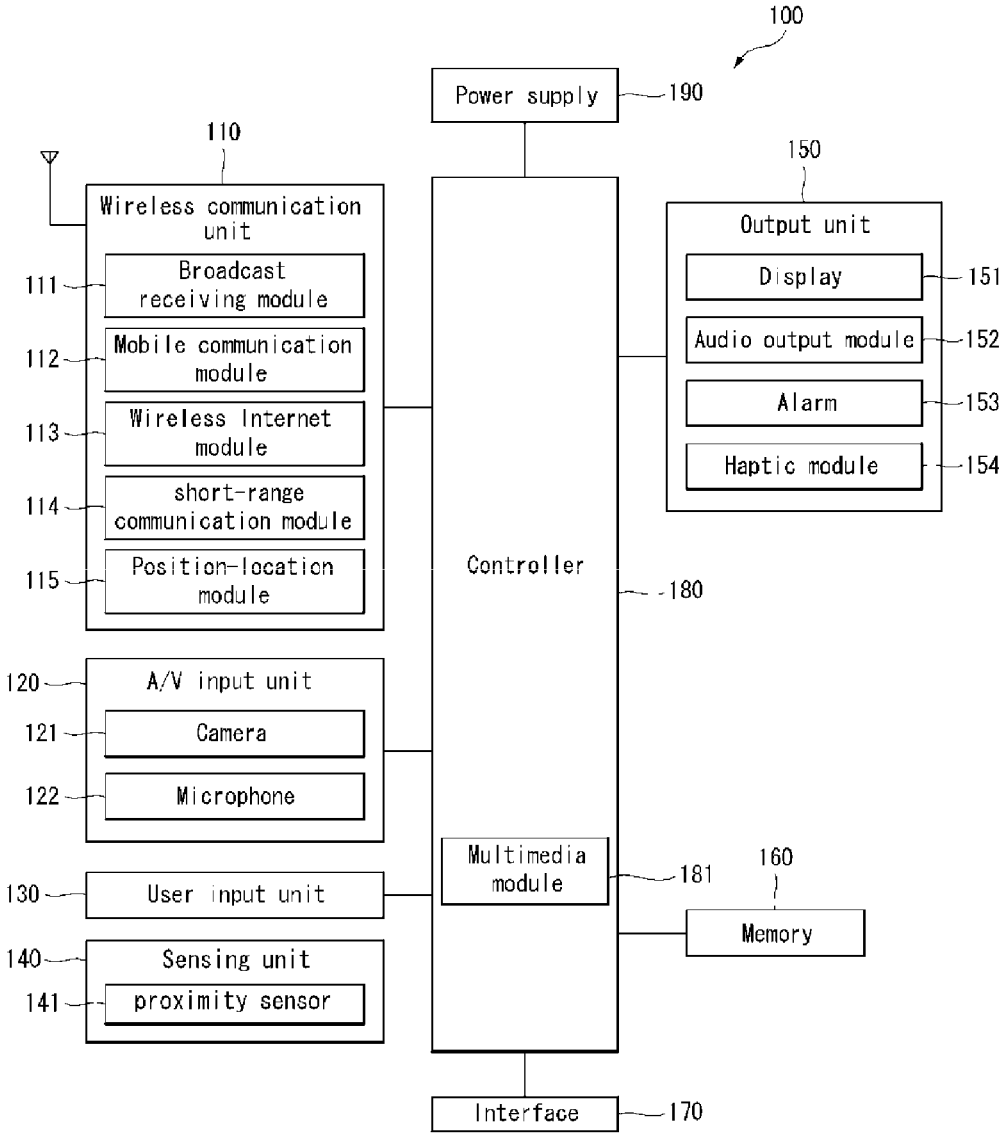
FIG. 1 is a block diagram of an electronic device according to an embodiment.

The above and other aspects, features and advantages of the present disclosure will be more apparent from the following detailed description taken in conjunction with the accompanying drawings. As the disclosure allows for various changes and numerous embodiments, a particular embodiment will be illustrated in the drawings and described in detail in the written description. Like reference numerals refer to like elements throughout the specification. In describing the present disclosure, detailed descriptions of well-known functions or configurations will be omitted in order to not necessarily obscure the subject matter of the present disclosure. Numerals (e.g., first, second, etc.) used in the description of the present disclosure are only for distinguishing one element from another element.

An electronic device according to the present disclosure may be described below with reference to the accompanying drawings. In the following description, suffixes "module" and "unit" may be given to components of the electronic device in consideration of only facilitation of description and do not have meanings or functions discriminated from each other.

The electronic device may include a cellular phone, a smart phone, a laptop computer, a digital broadcasting terminal, personal digital assistants (PDA), a portable multimedia player (PMP), a navigation system and/or so on. It should be apparent to those skilled in the art that a configuration according to an embodiment disclosed in this specification should be applicable to fixed or stationary terminals, such as a digital TV or a desktop computer, except for applications disclosed to be specific only to a mobile terminal.

A further description may be provided with regard to an electronic device, although such teachings may apply equally to other types of devices.

FIG. 1 is a block diagram of an electronic device in accordance with an example embodiment. Other embodiments and arrangements may also be provided. FIG. 1 shows an electronic device 100 having various components, although other components may also be used. More or less components may alternatively be implemented.

FIG. 1 shows that the electronic device 100 includes a wireless communication unit 110, an audio/video (A/V) input unit 120, a user input unit 130, a sensing unit 140, an output unit 150, a memory 160, an interface unit 170, a controller 180 and a power supply 190.

The wireless communication unit 110 may be configured with several components and/or modules. The wireless communication unit 110 may include a broadcast receiving module 111, a mobile communication module 112, a wireless Internet module 113, a short-range communication module 114 and a position-location module 115. The wireless communication unit 110 may include one or more components that permit wireless communication between the electronic device 100 and a wireless communication system or a network within which the electronic device 100 is located. In case of non-mobile devices, the wireless communication unit 110 may be replaced with a wire communication unit. The wireless communication unit 110 and the wire communication unit may be commonly referred to as a communication unit.

The broadcast receiving module 111 may receive a broadcast signal and/or broadcast associated information from an external broadcast managing entity via a broadcast channel. The broadcast channel may include a satellite channel and a terrestrial channel. The broadcast managing entity may refer to a system that transmits a broadcast signal and/or broadcast associated information.

At least two broadcast receiving modules 111 may be provided in the electronic device 100 to pursue simultaneous reception of at least two broadcast channels or facilitation of broadcast channel switching.

Examples of broadcast associated information may include information associated with a broadcast channel, a broadcast program, a broadcast service provider, etc. For example, broadcast associated information may include an electronic program guide (EPG) of digital multimedia broadcasting (DMB) and an electronic service guide (ESG) of digital video broadcast-handheld (DVB-H).

The broadcast signal may be a TV broadcast signal, a radio broadcast signal, and/or a data broadcast signal. The broadcast signal may further include a broadcast signal combined with a TV or radio broadcast signal.

The broadcast receiving module 111 may receive broadcast signals transmitted from various types of broadcast systems. As a non-limiting example, the broadcasting systems may include digital multimedia broadcasting-terrestrial (DMB-T), digital multimedia broadcasting-satellite (DMB-S), digital video broadcast-handheld (DVB-H), a data broadcasting system known as media forward link only (MediaFLO®) and integrated services digital broadcast-terrestrial (ISDB-T). The receiving of multicast signals may also be provided. Data received by the broadcast receiving module 111 may be stored in the memory 160, for example.

The mobile communication module 112 may communicate wireless signals with one or more network entities (e.g. a base station or Node-B). The signals may represent audio, video, multimedia, control signaling, and data, etc.

The wireless Internet module 113 may support Internet access for the electronic device 100. This wireless Internet module 113 may be internally or externally coupled to the electronic device 100. Suitable technologies for wireless Internet may include, but are not limited to, WLAN (Wireless LAN)(Wi-Fi), Wibro (Wireless broadband), Wimax (World Interoperability for Microwave Access), and/or HSDPA (High Speed Downlink Packet Access). The wireless Internet module 113 may be replaced with a wire Internet module in non-mobile devices. The wireless Internet module 113 and the wire Internet module may be referred to as an Internet module.

The short-range communication module 114 may facilitate short-range communications. Suitable technologies for short-range communication may include, but are not limited to, radio frequency identification (RFID), infrared data association (IrDA), ultra-wideband (UWB), as well as networking technologies such as Bluetooth and ZigBee.

The position-location module 115 may identify or otherwise obtain a location of the electronic device 100. The position-location module 115 may be provided using global positioning system (GPS) components that cooperate with associated satellites, network components, and/or combinations thereof.

The position-location module 115 may precisely calculate current 3-dimensional position information based on longitude, latitude and altitude by calculating distance information and precise time information from at least three satellites and then by applying triangulation to the calculated information. Location and time information may be calculated using three satellites, and errors of the calculated location position and time information may then be amended or changed using another satellite. The position-location module 115 may calculate speed information by continuously calculating a real-time current location.

The audio/video (A/V) input unit 120 may provide audio or video signal input to the electronic device 100. The A/V input unit 120 may include a camera 121 and a microphone 122. The camera 121 may receive and process image frames of still pictures and/or video.

The microphone 122 may receive an external audio signal while the electronic device is in a particular mode, such as a phone call mode, a recording mode and/or a voice recognition mode. The received audio signal may then be processed and converted into digital data.

The electronic device 100, and in particular the A/V input unit 120, may include a noise removing algorithm (or noise canceling algorithm) to remove noise generated in the course of receiving the external audio signal. Data generated by the A/V input unit 120 may be stored in the memory 160, utilized by the output unit 150, and/or transmitted via one or more modules of the wireless communication unit 110. Two or more microphones and/or cameras may also be provided.

The user input unit 130 may generate input data responsive to user manipulation of an associated input device or devices. Examples of such devices may include a keypad, a dome switch, a touchpad (e.g., static pressure/capacitance), a jog wheel and/or a jog switch. A specific example is one in which the user input unit 130 is configured as a touchpad in cooperation with a display, as will be described below.

The sensing unit 140 may provide status measurements of various aspects of the electronic device 100. For example, the sensing unit 140 may detect an open/close status (or state) of the electronic device 100, a relative positioning of components (e.g., a display and a keypad) of the electronic device 100, a change of position of the electronic device 100 or a component of the electronic device 100, a presence or absence of user contact with the electronic device 100, and/or an orientation or acceleration/deceleration of the electronic device 100.

The electronic device 100 may be configured as a slide-type electronic device. In such a configuration, the sensing unit 140 may sense whether a sliding portion of the electronic device 100 is open or closed. The sensing unit 140 may also sense presence or absence of power provided by the power supply 190, presence or absence of a coupling or other connection between the interface unit 170 and an external device, etc.

The sensing unit 140 may include a proximity sensor 141, a motion detecting sensor 142, a brightness detecting sensor 143, a distance detecting sensor 144, and/or a heat detecting sensor 145. Details of the proximity sensor 141 and the other sensors 142, 143, 144 and 145 may be explained below.

The motion detecting sensor 142 may detect a motion state of the electronic device 100 by an external force such as an external shock, an external vibration and/or the like. The motion detecting sensor 142 may detect a motion extent. The motion detecting sensor 142 may be provided with a rotational body and detect a motion of the device by detecting a property of a mechanical movement of the rotational body. Based on speed, acceleration and direction of the motion, the motion detecting sensor 142 may detect either the motion extent or a motion pattern and then output the detected one to the controller 180. The motion detecting sensor 142 may include a gyro sensor.

The brightness detecting sensor 143 may detect a brightness of light around the electronic device 100 and then output the detected brightness to the controller 180.

The distance detecting sensor 144 may include an ultrasonic sensor or the like. The distance detecting sensor 144 may measure a distance between the electronic device 100 and a user and then output the detected distance to the controller 180.

The heat detecting sensor 145 may be provided around the display 151 of the device body. The heat detecting sensor 145 may detect the temperature on user's contact with the device body and then output the detected temperature to the controller 180.

The output unit 150 may generate an output relevant to a sight sense, an auditory sense, a tactile sense and/or the like. The output unit 150 may include a display 151, an audio output module 152, an alarm 153, a haptic module 154 and/or the like.

The display 151 may display (output) information processed by the device 100. For example, in case that the device is in a call mode, the display 151 may display a user interface (UI) or a graphic user interface (GUI) associated with the call. If the electronic device 100 is in a video communication mode or a photograph mode, the display 151 may display a photographed and/or received picture, a UI or a GUI.

The display 151 may include at least one of a liquid crystal display (LCD), a thin film transistor liquid crystal display (TFT LCD), an organic light-emitting diode (OLED), a flexible display, and a 3-dimensional display.

The display 151 may have a transparent or light-transmittive type configuration to enable an external environment to be seen through. This may be called a transparent display. A transparent OLED (TOLED) may be an example of a transparent display. A backside structure of the display 151 may also have the light-transmittive type configuration. In this configuration, a user may see an object located behind the device body through the area occupied by the display 151 of the device body.

At least two displays 151 may also be provided. For example, a plurality of displays may be provided on a single face of the device 100 by being built in one body or spaced apart from the single face. Alternatively, each of a plurality of displays may be provided on different faces of the device 100.

If the display 151 and a sensor for detecting a touch action (hereafter a touch sensor) are constructed in a mutual-layered structure (hereafter a touchscreen), the display 151 may be used as an input device as well as an output device. For example, the touch sensor may include a touch film, a touch sheet, a touchpad and/or the like.

The touch sensor may convert a pressure applied to a specific portion of the display 151 or a variation of electrostatic capacity generated from a specific portion of the display 151 to an electric input signal. The touch sensor may detect a pressure of a touch as well as a position and size of the touch.

If a touch input is provided to the touch sensor, signal(s) corresponding to the touch input may be transferred to a touch controller. The touch controller may process the signal(s) and then transfer corresponding data to the controller 180. The controller 180 may therefore know which portion of the display 151 is touched.

FIG. 1 shows that the proximity sensor 141 can be provided within the electronic device 100 enclosed by the touchscreen or around the touchscreen. The proximity sensor 141 may detect a presence or non-presence of an object approaching a prescribed detecting surface or an object existing around the proximity sensor 141 using an electromagnetic field strength or infrared ray without mechanical contact. The proximity sensor 141 may have a longer durability than the contact type sensor and may also have a greater usage than the contact type sensor.

The proximity sensor 141 may include one of a transmittive photoelectric sensor, a direct reflective photoelectric sensor, a mirror reflective photoelectric sensor, a radio frequency oscillation proximity sensor, an electrostatic capacity proximity sensor, a magnetic proximity sensor, an infrared proximity sensor and/or the like. If the touchscreen is an electrostatic type, the proximity sensor 141 may detect proximity of a pointer using a variation of an electric field according to the proximity of the pointer. In this case, the touchscreen (touch sensor) may be classified into the proximity sensor.

An action in which a pointer approaches the touchscreen without contacting the touchscreen may be called a proximity touch. An action in which a pointer actually touches the touchscreen may be called a contact touch. The location of the touchscreen proximity-touched by the pointer may be the position of the pointer that vertically opposes the touchscreen when the pointer performs the proximity touch.

The proximity sensor 141 may detect a proximity touch and/or a proximity touch pattern (e.g., a proximity touch distance, a proximity touch duration, a proximity touch position, a proximity touch shift state, etc.). Information corresponding to the detected proximity touch action and/or the detected proximity touch pattern may be outputted to the touchscreen.

The audio output module 152 may output audio data that is received from the wireless communication unit 110 in a call signal reception mode, a call mode, a recording mode, a voice recognition mode, a broadcast receiving mode and/or the like. The audio output module 152 may output audio data stored in the memory 160. The audio output module 152 may output an audio signal relevant to a function (e.g., a call signal receiving sound, a message receiving sound, etc.) performed by the electronic device 100. The audio output module 152 may include a receiver, a speaker, a buzzer and/or the like.

The alarm 153 may output a signal for announcing an event occurrence of the electronic device 100. An event occurring in the electronic device 100 may include one of a call signal reception, a message reception, a key signal input, a touch input and/or the like. The alarm 153 may output a signal for announcing an event occurrence by way of vibration or the like as well as a video signal or an audio signal. The video signal may be outputted via the display 151. The audio signal may be outputted via the audio output module 152. The display 151 or the audio output module 152 may be classified as part of the alarm 153.

The haptic module 154 may bring about various haptic effects that can be sensed by a user. Vibration is a representative example for the haptic effect brought about by the haptic module 154. Strength and pattern of the vibration generated from the haptic module 154 may be controllable.

For example, vibrations differing from each other may be outputted in a manner of being synthesized together or may be sequentially outputted.

The haptic module 154 may generate various haptic effects including a vibration, an effect caused by such a stimulus as a pin array vertically moving against a contact skin surface, a jet power of air via outlet, a suction power of air via inlet, a skim on a skin surface, a contact of an electrode, an electrostatic power and the like, and/or an effect by hot/cold sense reproduction using an endothermic or exothermic device as well as the vibration.

The haptic module 154 may provide the haptic effect via direct contact. The haptic module 154 may enable a user to experience the haptic effect via muscular sense of a finger, an arm and/or the like. Two or more haptic modules 154 may be provided according to a configuration of the electronic device 100.

The memory 160 may store a program for operations of the controller 180. The memory 160 may temporarily store input/output data (e.g., phonebook, message, still picture, moving picture, etc.). The memory 160 may store data of vibration and sound in various patterns outputted in case of a touch input to the touchscreen.

The memory 160 may include at least one of a flash memory, a hard disk, a multimedia card micro type memory, a card type memory (e.g., SD memory, XD memory, etc.), a random access memory (RAM), a static random access memory (SRAM), a read-only memory (ROM), an electrically erasable programmable read-only memory, a programmable read-only memory, a magnetic memory, a magnetic disk, an optical disk, and/or the like. The electronic device 100 may operate in association with a web storage that performs a storage function of the memory 160 in the Internet.

The interface unit 170 may play a role as a passage to external devices connected to the electronic device 100. The interface unit 170 may receive data from an external device. The interface unit 170 may be supplied with a power and then the power may be delivered to elements within the electronic device 100. The interface unit 170 may enable data to be transferred to an external device from an inside of the electronic device 100. The interface unit 170 may include a wire/wireless headset port, an external charger port, a wire/wireless data port, a memory card port, a port for coupling to a device having an identity module, an audio input/output (I/O) port, a video input/output (I/O) port, an earphone port and/or the like.

The identity module may be a chip or card that stores various kinds of information for authenticating use of the electronic device 100. The identify module may include a user identity module (UIM), a subscriber identity module (SIM), a universal subscriber identity module (USIM) and/or the like. A device provided with the above identity module (hereafter an identity device) may be manufactured in the form of a smart card. The identity device may be connected to the electronic device 100 via the port.

The interface unit 170 may play a role as a passage for supplying a power to the electronic device 100 from a cradle that is connected to the electronic device 100. The interface unit 170 may play a role as a passage for delivering various command signals, which are inputted from the cradle by a user, to the electronic device 100. Various command signals inputted from the cradle or the power may work as a signal for recognizing that the electronic device 100 is correctly loaded in the cradle.

The controller 180 may control overall operations of the electronic device 100. For example, the controller 180 may perform control and processing relevant to a voice call, a data communication, a video conference and/or the like. The controller 180 may have a multimedia module 181 for multimedia playback. The multimedia module 181 may be implemented within the controller 180 or may be configured separate from the controller 180.

The controller 180 may perform pattern recognizing processing for recognizing a handwriting input performed on the touchscreen as a character and/or recognizing a picture drawing input performed on the touchscreen as an image.

The power supply 190 may receive an external or internal power and then supply the power required for operations of the respective elements under control of the controller 180.

Embodiments of the present disclosure explained in the following description may be implemented within a recording medium that can be read by a computer or a computer-like device using software, hardware or combination thereof.

According to the hardware implementation, arrangements and embodiments may be implemented using at least one of application specific integrated circuits (ASICs), digital signal processors (DSPs), digital signal processing devices DSPDs), programmable logic devices (PLDs), field programmable gate arrays (FPGAs), processors, controllers, microcontrollers, microprocessors and electric units for performing other functions. In some cases, embodiments may be implemented by the controller 180.

For a software implementation, arrangements and embodiments described herein may be implemented with separate software modules, such as procedures and functions, each of which may perform one or more of the functions and operations described herein. Software codes may be implemented with a software application written in any suitable programming language and may be stored in memory such as the memory 160, and may be executed by a controller or processor, such as the controller 180.

Figure 2:
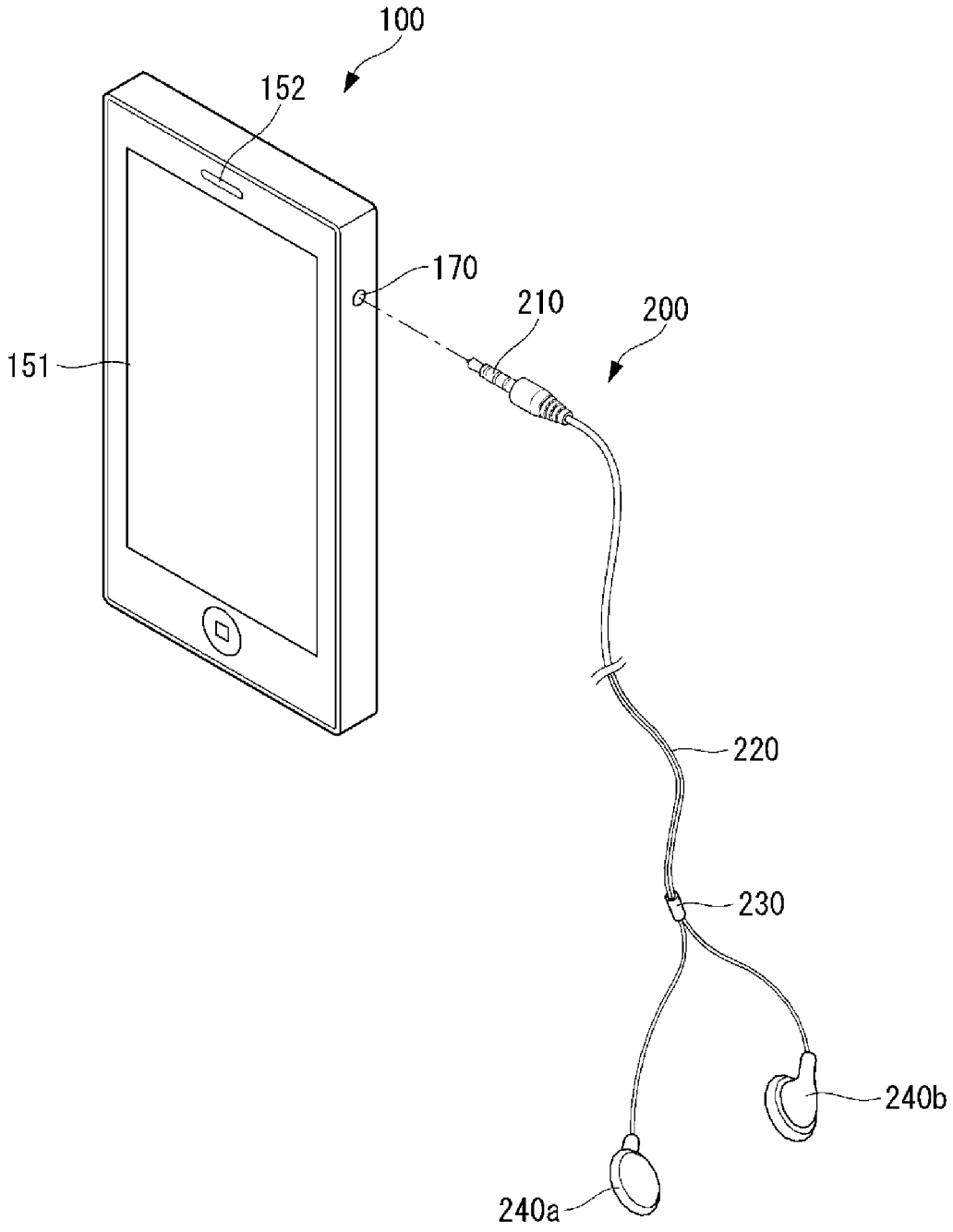
FIG. 2 is a perspective view illustrating a combination of an electronic device and an earphone according to an embodiment.
Figure 3:
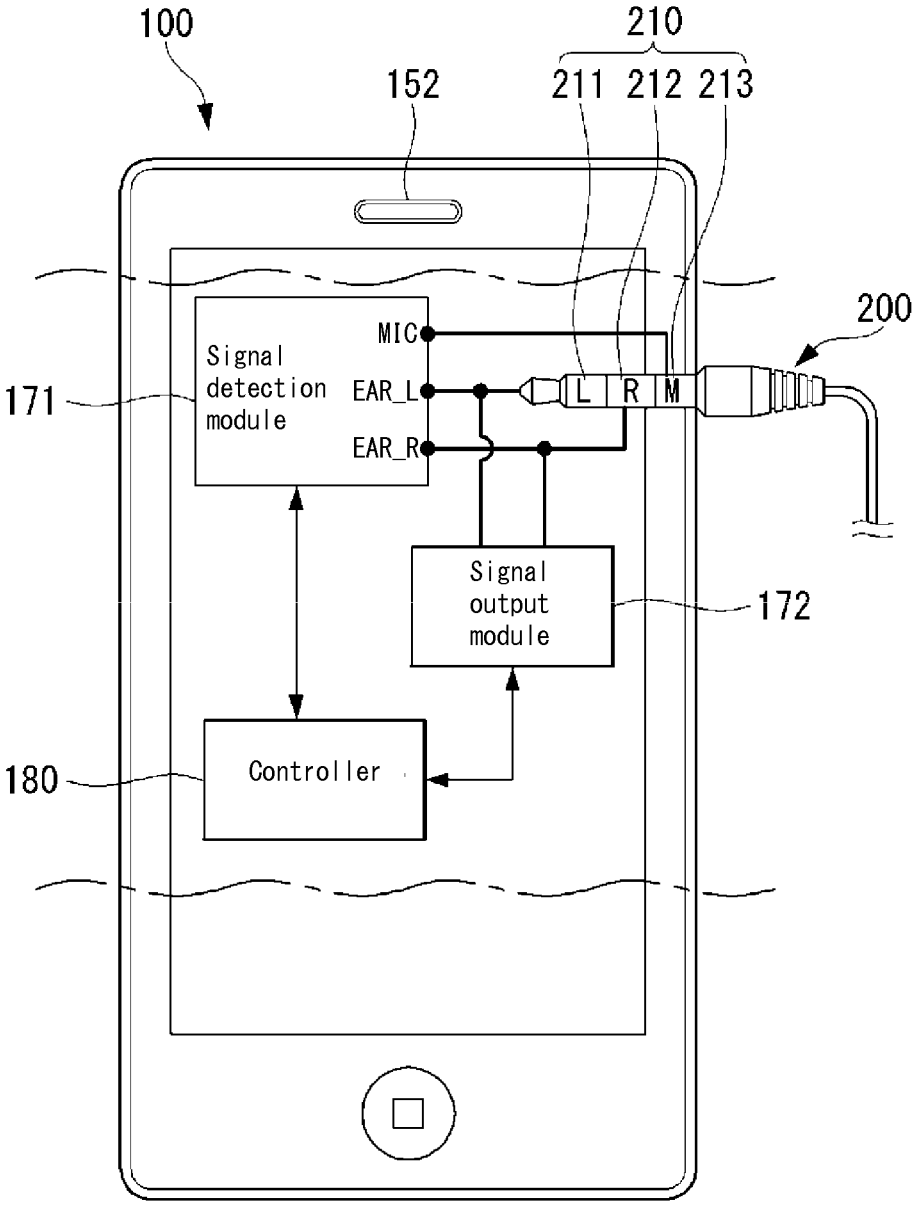
FIG. 3 is a perspective view illustrating a front surface of the electronic device according to an embodiment.
Figure 4:
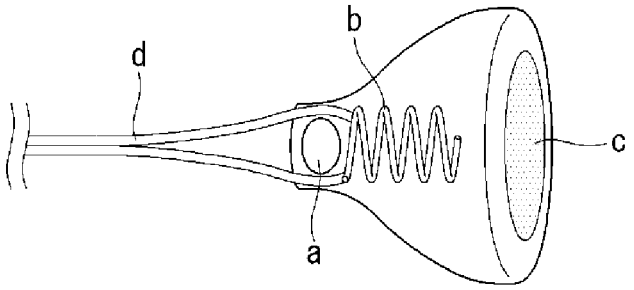
FIG. 4 is a diagram illustrating a signal transfer principle from the earphone.

FIG. 2 is a perspective view illustrating a combination of an electronic device and an earphone according to an embodiment, FIG. 3 is a perspective view illustrating a front surface of the electronic device according to an embodiment, and FIG. 4 is a diagram illustrating a signal transfer principle from the earphone.

Referring to FIG. 2, the electronic device 100 may be connected with an earphone plug 210 of an earphone 200 being an external device through the interface unit 170. The interface unit 170 may be an earphone jack or socket.

The interface unit 170 of the electronic device is a configuration to transmit and receive a signal to and from the earphone 200 being the external device, and may be formed corresponding to a shape of the earphone plug 210 of the earphone.

The earphone 200 may include the earphone plug 210, a connector 220, an operating unit 230, and earphone output units 240*a* and 240*b*. The earphone plug 210 may connect with the electronic device 100 to receive and transfer an electric signal from and to the electronic device 100. Left/right earphone output units 240*a* and 240*b* (also earbuds, buds, speaker, etc.) may be electrically isolated from a region corresponding to a microphone (not shown) formed at the earphone. Further, regions of the earphone plug 210 corresponding to the left/right earphone output units 240*a* and 240*b* may be electrically isolated from a region of the earphone plug 210 corresponding to a microphone through a ground.

The connector 220 transfers a signal from the earphone plug 210 to the left/right earphone output units 240*a* and 240*b*. The operating unit 230 may adjust magnitude of an electric signal from the electronic device 100, that is, a volume of a sound signal. Further, a microphone may be additionally attached to the operating unit 230. The operating unit 230 may be referred to as a switch, button, or the like.

The left/right earphone output units 240*a* and 240*b* may be inserted into ears of the user, and may convert an electric signal to be transferred through the earphone plug 210 into a sound signal to transfer the converted sound signal to the user.

That is, the earphone 200 may transfer an electric signal to the left/right earphone output units 240*a* and 240*b* through the interface unit 170, and may transfer a sound from the microphone formed at the operating unit 230 to the electronic device 100 through a microphone region of the earphone plug 210.

Since whether to transfer the sound to the earphone 200 through the interface unit 170 is determined according to a control signal generated from the controller 180 of the electronic device shown in FIG. 1, the controller 180 of FIG. 1 may select an output unit of a sound.

Accordingly, when the earphone 200 is connected to the electronic device 100, the controller 180 of FIG. 1 does not transfer the sound to the earphone 200 but may output the sound through an external speaker 152 of the electronic device 100 in certain situations, for example, when it is determined that the earphone 200 is not worn by the user.

Referring to FIG. 3, the electronic device 100 may process the signal in conjunction with a signal detection module 171, a signal output module 172, and a controller 180.

When the earphone plug 210 of the earphone is combined through the interface unit 170 of the electronic device, the controller 180 of the electronic device are electrically connected to a left earphone output unit region (L) 211 or a right earphone output unit (R) 212, and a microphone region (M) 213 and may transmit or receive to or from respective regions.

The interface unit 170 of the electronic device 100 may include a signal detection module 171 and a signal output module 172. The controller 180 may control the signal detection module 171 or the signal output module 172 according to whether an operation state of the earphone 200 is an output mode or an input mode.

In detail, when the earphone 200 is used in the output mode, the controller 180 may transfer the electric signal to the left earphone output unit region (L) 211 or the right earphone output unit (R) 212 through the signal output module 172. Accordingly, the controller 180 may output an audio signal through an earphone output unit.

When the earphone 200 is used in the input mode, the controller 180 may detect an electric signal from at least one on the left earphone output unit region (L) 211, the right earphone output unit (R) 212, and the microphone region (M) 213.

According to the embodiment, a sound signal input from the left or right earphone output unit as well as a sound signal input from the microphone may be detected through a signal detection module 171 of the electronic device.

The earphone output unit performs a function of outputting a sound signal by a following principle, but may receive a reflective signal with respect to the output sound signal. An operation principle of the earphone output unit will be described in detail with reference to FIG. 4.

Referring to FIG. 4, the earphone output unit may convert the electric signal from the electronic device 100 into a sound signal to output the converted sound signal.

In detail, the earphone output unit may include a magnet a, a coil b, and a diaphragm c, and the coil b may be connected to an earphone connector d to receive an electric signal from the earphone connector d.

As the coil b induces a magnetic force according to a received electric signal, a distance between the magnet a and the coil b is changed so that a thin film such as the diaphragm c may vibrate due to the distance difference to form a sound wave in air.

Due to the above principle, the earphone output unit may convert the electric signal into the sound signal to output the converted sound signal.

Further, when the reflective signal is received through the diaphragm c on the contrary, that is, when vibration of the diaphragm c is received, the earphone output unit may change a distance between the magnet a and the coil b, and converts the distance difference into an electric signal.

Accordingly, when the reflective signal corresponding to the sound signal output through the earphone output unit vibrates the diaphragm c (e.g., when the user wears the earphone), the signal detection module 271 may acquire an electric signal from each region 211 or 212 of the earphone plug through the connector d.

The controller 180 may control the signal detection module 171 or the signal output module 172 to divide an operation mode the earphone 200 into an input mode and an output mode. For example, the controller 180 may fundamentally set the operation mode of the earphone 200 as an output mode, and may set the operation mode of the earphone 200 as an input mode for a time set at a predetermined time.

Further, the controller 180 may set the operation mode of the earphone 200 as an output mode, and may set at the input mode at a predetermined time during use of the output mode. The predetermined time may include a case where a preset period comes when the period is set, a case of switching a played music during playback of music, and a case of receiving a specific event such as upon reception of the telephone and upon reception of a message alarm. The predetermined time may be set to include various cases except for the foregoing embodiments.

When acquiring the electric signal through the signal detection module 271, the controller 180 may detect magnitude or a frequency of the acquired electric signal, and compare a variation amount in the magnitude or the frequency of the acquired electric signal with a reference value to determine whether the earphone is worn. The variation amount in the magnitude or the frequency of the electric signal may include a variation amount in the magnitude or the frequency of the electric signal in the output mode or a variation amount in the magnitude or the frequency of the electric signal in the input mode. The reference value may be set by taking magnitude or a frequency and a noise of an audio signal in the output mode. For example, the reference value may be set as a sum of maximum magnitude of the audio signal and an offset value respect to the noise in the output mode.

The controller 180 may determine whether a left or right earphone is worn by comparing a variation amount in the magnitude or the frequency of the electric signal acquired from each region 211 or 212 of the earphone plug with the reference value.

In detail, when the variation amount in the magnitude or the frequency of the electric signal is equal to or greater than the reference value, the controller 180 determines that the earphone 200 is worn. When the variation amount in the magnitude or the frequency of the electric signal is less than the reference value, the controller 180 determines that the earphone 200 is not worn.

When it is determined that the earphone is worn, the controller 180 outputs the sound through the earphone. When it is determined that the earphone is not worn, the controller 180 outputs the sound through the external speaker 152.

The controller 180 acquires an electric signal separated from a left earphone plug region (L) 211 corresponding to a left earphone or a right earphone plug region (R) 212 to control to reduce a volume of the sound output through one side earphone when one of the left earphone or the right earphone is worn.

Since one of the two worn earphones may be removed from the ear in order to hear an external sound, there is a need to control so that the user can clearly hear the external sound by reducing a volume of the sound output through the worn earphone.

The controller 180 may set the operation mode of the earphone so that the input mode and the output mode are simultaneously operated. As described above, the controller 180 may set to be operated in the input mode only at a predetermined time.

Further, when receiving the electric signal acquired from the signal detection module of the wireless earphone, the controller 180 may analyze the received electric signal to determine whether the wireless earphone is worn.

Hereinafter embodiments of the present disclosure will be described in detail.

Figure 5:
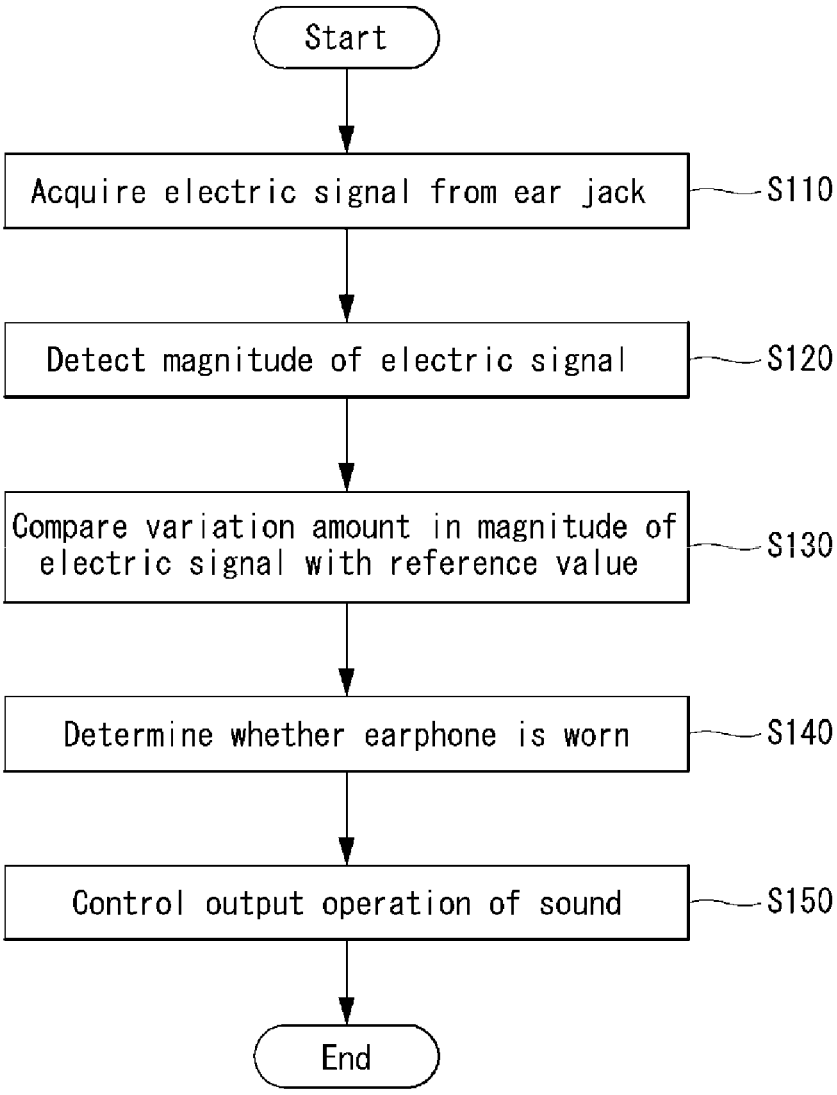
FIG. 5 is a flowchart illustrating a method for controlling an electronic device according to a first embodiment.
Figure 6:
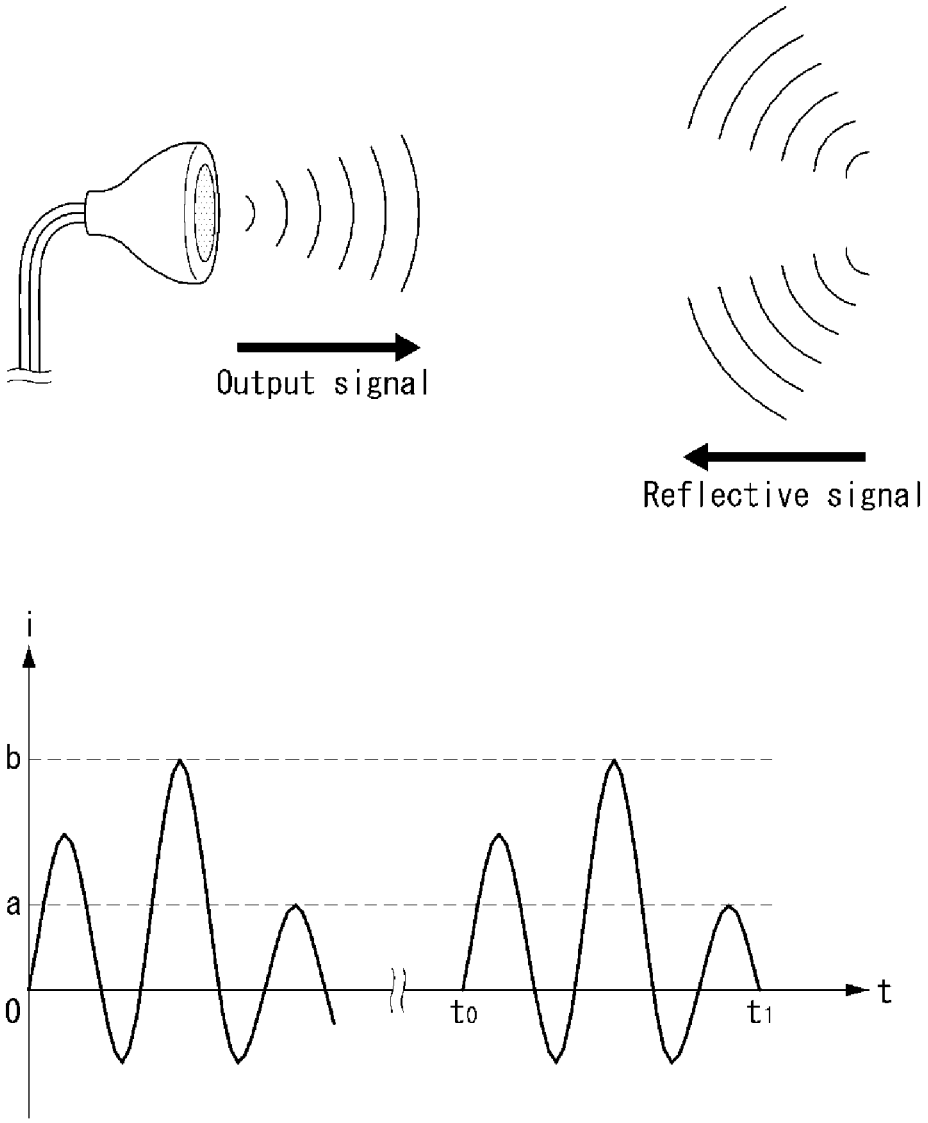
FIGS. 6 and 7 are diagrams illustrating a method for controlling an electronic device according to a first embodiment.
Figure 7:
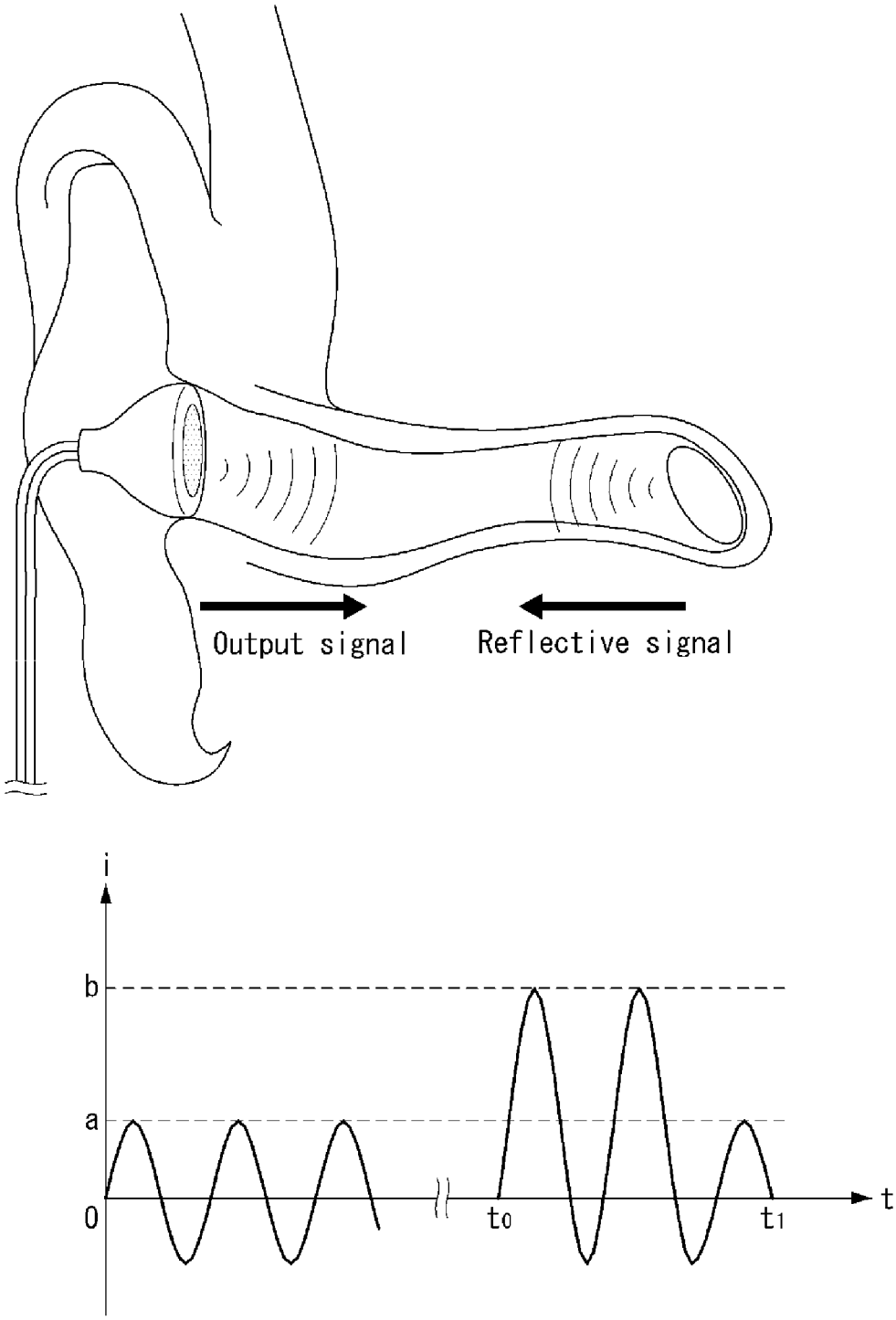

FIG. 5 is a flowchart illustrating a method for controlling an electronic device according to a first embodiment, and FIGS. 6 and 7 are diagrams illustrating a method for controlling an electronic device according to a first embodiment.

According to the first embodiment, a controller 180 of FIG. 1 may acquire an electric signal from an earphone plug (S110), detect magnitude of the acquired electric signal (S120), and compare a variation amount in the magnitude of the electric signal with a reference value (S130).

The controller 180 of FIG. 1 may determine whether the earphone is worn based on a result of analyzing the electric signal (S140). In this case, the controller 180 of FIG. 1 may independently determine with respect to left/right earphones whether the earphone is worn.

The controller 180 of FIG. 1 may control an output operation of the sound according to whether the earphone is worn. In detail, the controller 180 of FIG. 1 may determine whether to output the sound through an external speaker or an earphone, and may adjust a volume of the sound output through the earphone.

The controller 180 of FIG. 1 may determine to set the operation mode of the earphone as an output mode or an input mode. When the operation mode of the earphone is set as the input mode, the controller 180 of FIG. 1 may acquire the electric signal from the earphone plug through the signal detection module.

When the earphone is not worn, as shown in FIG. 6, since a reflective signal with respect to a signal output from the earphone is scattered in air, the acquired electric signal may have a wave substantially similar to that of the electric signal in the output mode.

When the earphone is used in the output mode from time point t=0 to a current time and is used in the input mode from time point t=t0 to a preset time, the electric signal may be detected through the signal detection module.

The controller 180 of FIG. 1 detects magnitude of the electric signal acquired from time point t0 to a preset time (t0~t1), and may calculate and compare a variation amount between magnitude of the detected electric signal and magnitude of the electric signal in the output mode with the reference value.

The controller 180 of FIG. 1 may set a sum of a maximum value of the electric signal and a difference between the maximum value and a minimum value of the electric signal. In this case, the reference value may be set as 'b+(b−a),' where b is the maximum value and a is the minimum value.

Since the variation amount in the magnitude of the electric signal is less than the reference value, the controller 180 of FIG. 1 may determine that the earphone is not worn. When the earphone is not worn, the controller 180 of FIG. 1 may control the electronic device to perform a sound control operation according to a preset operation state of the electronic device.

Conversely, when the earphone is worn, as shown in FIG. 7, since a reflective signal with respect to the signal output from the earphone is again transferred to the earphone through, for example, a blocked ear canal, it may be understood that the acquired electric signal is larger than a wave of the electric signal in the output mode.

When the earphone is used in the output mode from time point t=0 to a current time and is used in the input mode from time point t=t0 to a preset time, the controller 180 of FIG. 1 may detect the electric signal through the signal detection module from time point t0 The controller 180 of FIG. 1 may detect magnitude of the electric signal acquired from time point t0 to a preset time (t0~t1), and calculate and compare a variation amount between the detected magnitude of the electric signal and magnitude of the electric signal in the output mode with a reference value.

The controller 180 of FIG. 1 may set the reference value as a sum of a maximum value of the electric signal in the output mode and a difference between the maximum value and a minimum value of the electric value. In this case, the reference value may be set as 'b+(b−a),' where b is the maximum value and a is the minimum value.

Since the variation amount in the magnitude of the electric signal is equal to or greater than the reference value, the controller 180 of FIG. 1 may determine that the earphone is worn. When the earphone is worn, the controller 180 of FIG. 1 may control the electronic device to perform a sound control operation according to a preset operation state of the electronic device.

Figure 8:
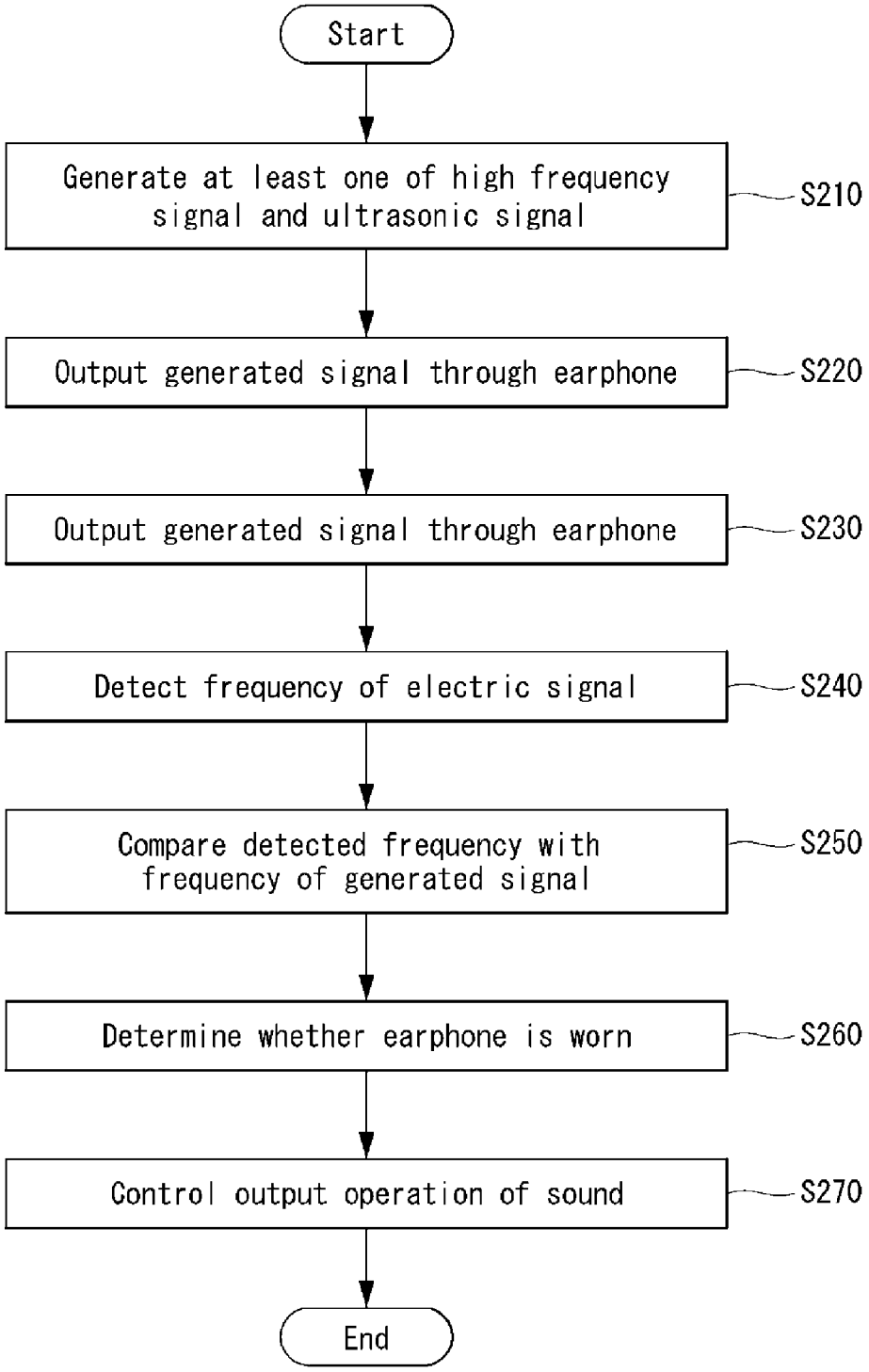
FIG. 8 is a flowchart illustrating a method for controlling an electronic device according to a second embodiment.
Figure 9:
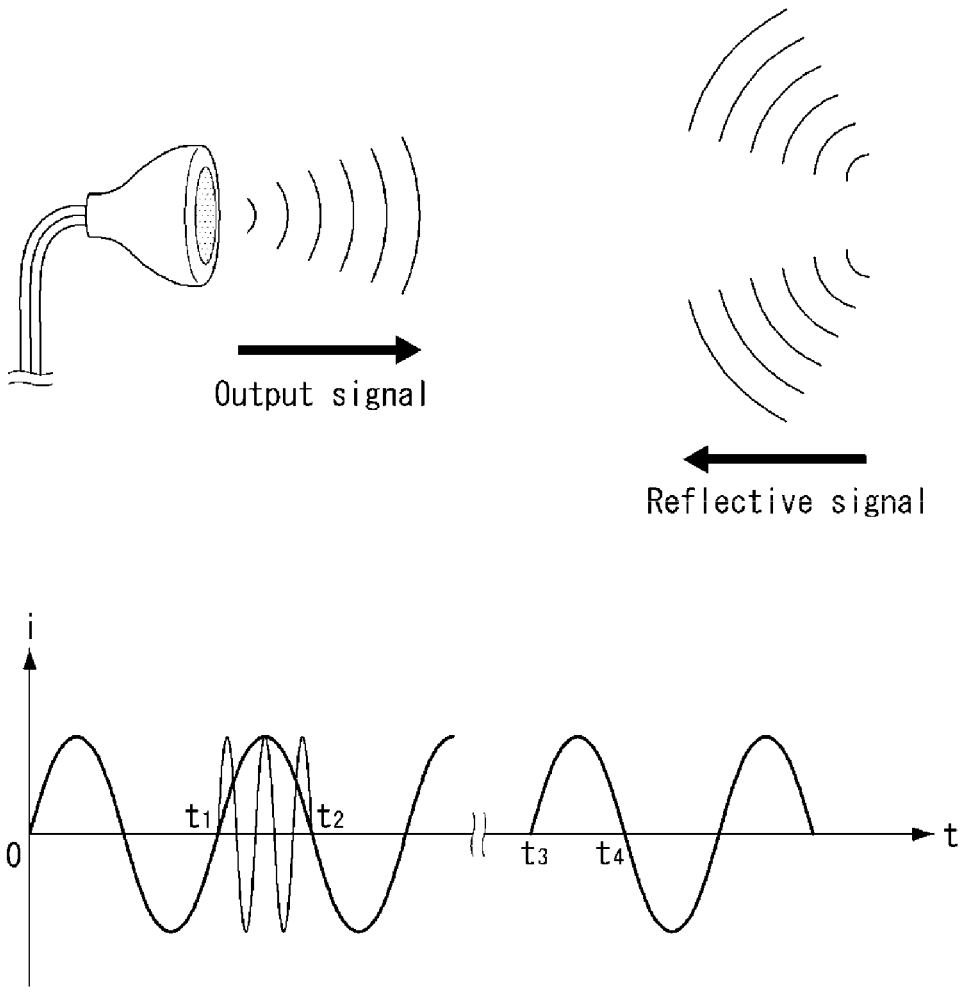
FIGS. 9 and 10 are diagrams illustrating a method for controlling an electronic device according to a second embodiment.
Figure 10:
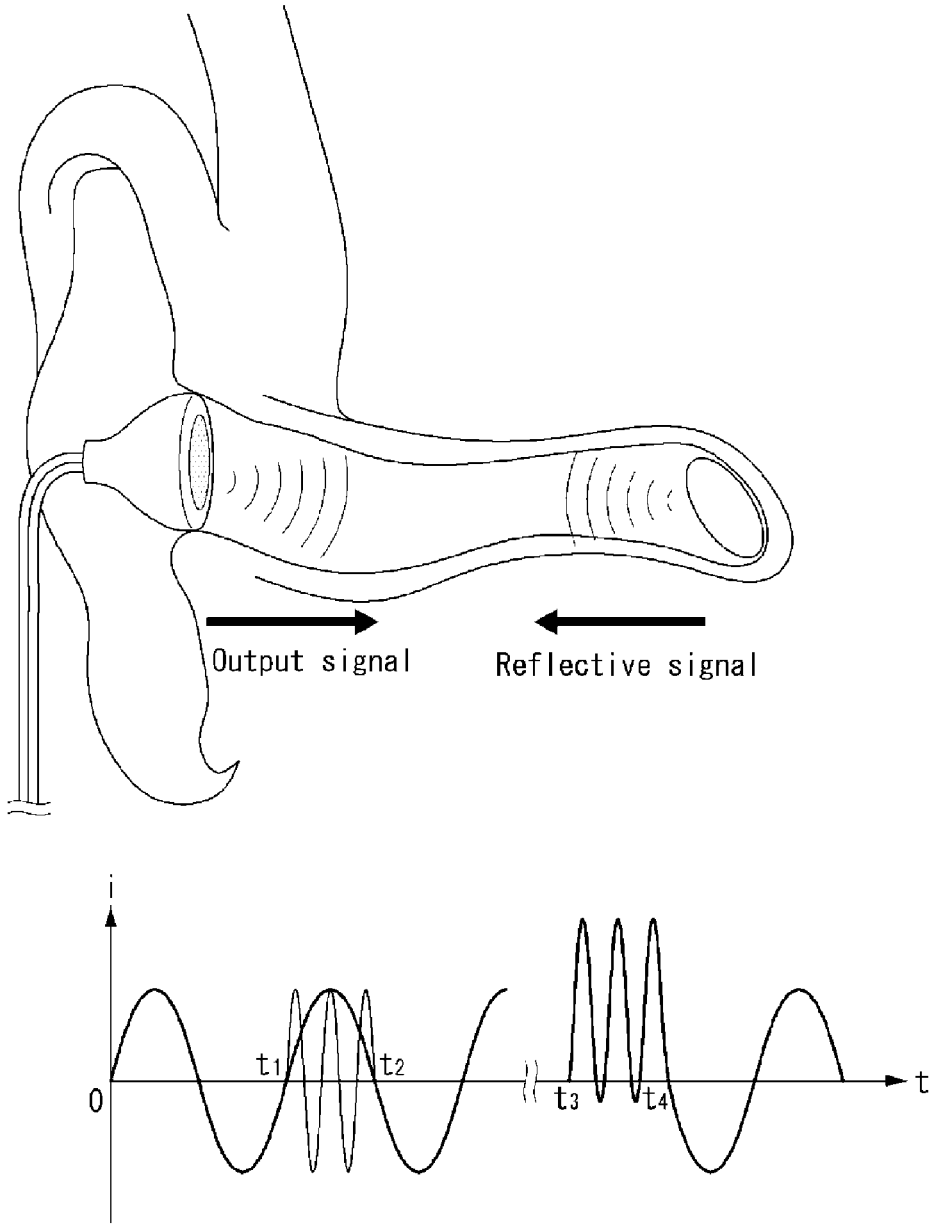

FIG. 8 is a flowchart illustrating a method for controlling an electronic device according to a second embodiment, and FIGS. 9 and 10 are diagrams illustrating a method for controlling an electronic device according to a second embodiment.

According to the second embodiment, the controller 180 of FIG. 1 generates at least one of a high frequency signal and an ultrasonic signal (S210), and may output the generated signal through an earphone (S220). The controller 180 of FIG. 1 may mix with the high frequency signal or the ultrasonic signal among an audio signal output, or may temporarily stop the audio signal output but output the high frequency signal or the ultrasonic signal.

The controller 180 of FIG. 1 may acquire an electric signal from an earphone plug (S230), and may detect a frequency of the electric signal (S240). In this case, the controller 180 of FIG. 1 may output the generated signal and then set the operation mode of the earphone as an input mode, and acquire a reflective signal.

The controller 180 of FIG. 1 may compare with the detected frequency of the electric signal with a generated frequency of a signal (S250), and may determine whether the earphone is worn (S260). When the detected frequency of the electric signal is substantially equal to or exceeds the generated frequency of a signal, the controller 180 of FIG. 1 determines that the earphone is worn. When the detected frequency of the electric signal is less than the generated frequency of a signal, the controller 180 of FIG. 1 determines that the earphone is not worn.

The controller 180 of FIG. 1 may the operation mode of the earphone as the input mode only at predetermined time point. The predetermined time point may include cases where specific events occur including a case where a preset period comes, when a phone call is received, and when a SMS is received.

Next, the controller 180 of FIG. 1 may control an output operation of a sound as a preset operation according to whether the earphone is worn (S270).

In detail, for example, a case where the controller 180 of FIG. 1 outputs a high frequency signal or an ultrasonic signal from t1 to t2 while using the earphone in the output mode from 0 to a current time point, and simultaneously use the earphone in the input mode and the output mode from t3 to t4 will be described in the embodiment.

When the earphone is not worn, as shown in FIG. 9, since a reflective signal with respect to the signal output from the earphone is scattered in air, the acquired electric signal may be similar to a wave of the electric signal in the output mode. Accordingly, the controller 180 of FIG. 1 may detect a similar frequency in the input mode of the earphone.

The controller 180 of FIG. 1 may compare a frequency of the acquired electric signal from t3 to t4 through the signal detection module with a frequency of a high signal or an ultrasonic signal. When the detected frequency is less than the frequency of the generated signal, the controller 180 of FIG. 1 may determine that the earphone is not worn.

Conversely, when the earphone is worn, as shown in FIG. 10, since a reflective signal with respect to the signal output from the earphone is again transferred to the earphone through, for example, a blocked ear canal, it may be understood that the frequency of the acquired electric signal is similar to the frequency of the generated frequency.

The controller 180 of FIG. 1 may compare a frequency of an electric signal acquired from t3 to t4 with a frequency of a generated high frequency signal or a generated ultrasonic signal. When the detected frequency is substantially equal to the frequency of the generated signal, the controller 180 of FIG. 1 may determine that the earphone is worn.

In this case, when a difference between the detected frequency and the frequency of the generated signal is within an error range, the controller 180 of FIG. 1 may determine that the earphone is worn.

Further, the controller 180 of FIG. 1 sets a reference value of the frequency. When the detected frequency is equal to or greater than the reference value, the controller 180 of FIG. 1 may determine that the earphone is worn. When the detected frequency is less than the reference value, the controller 180 of FIG. 1 may determine that the earphone is not worn. In this case, the reference value may include a frequency of the generated signal.

Figure 11:
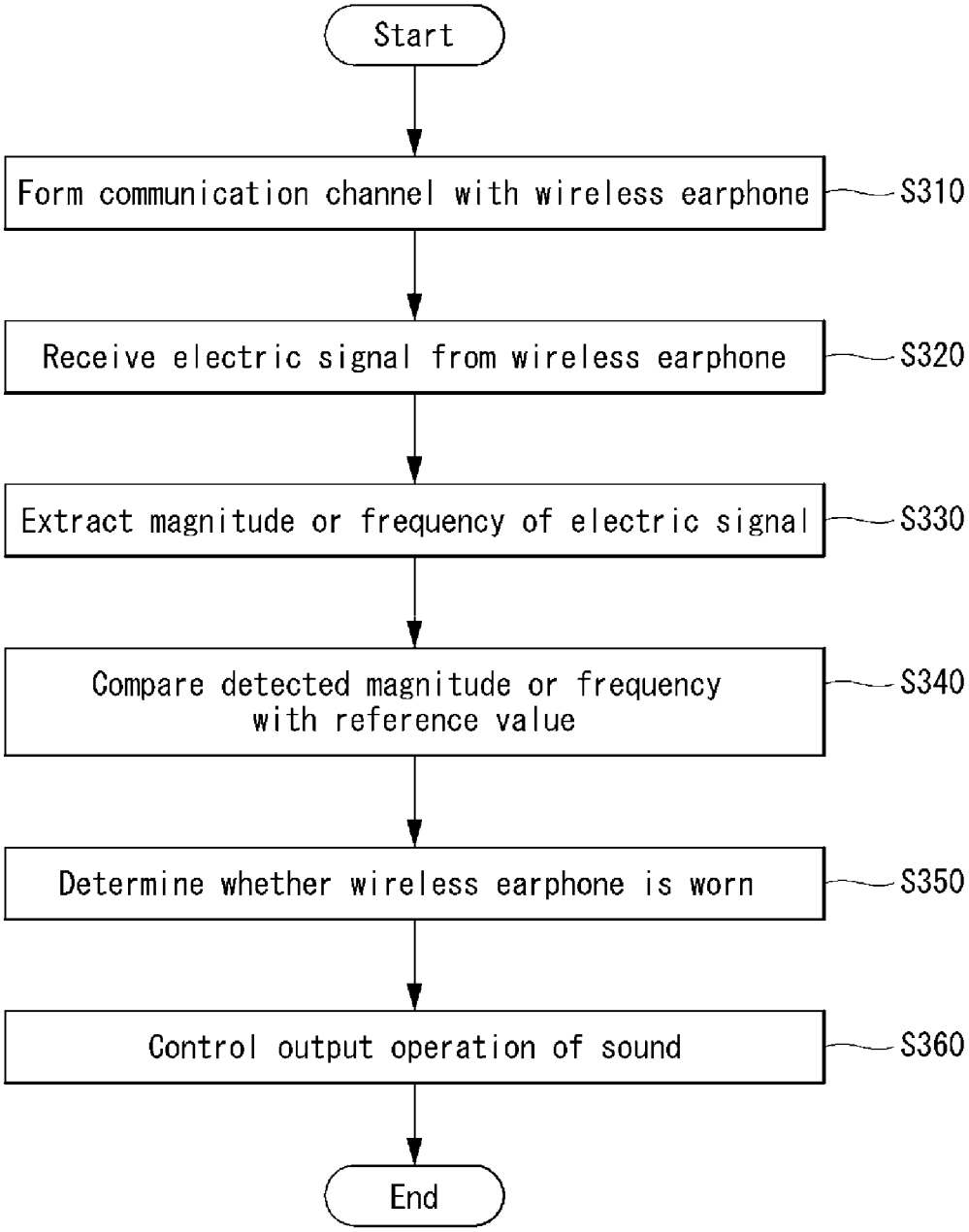
FIG. 11 is a flowchart illustrating a method for controlling an electronic device according to a third embodiment.
Figure 12:
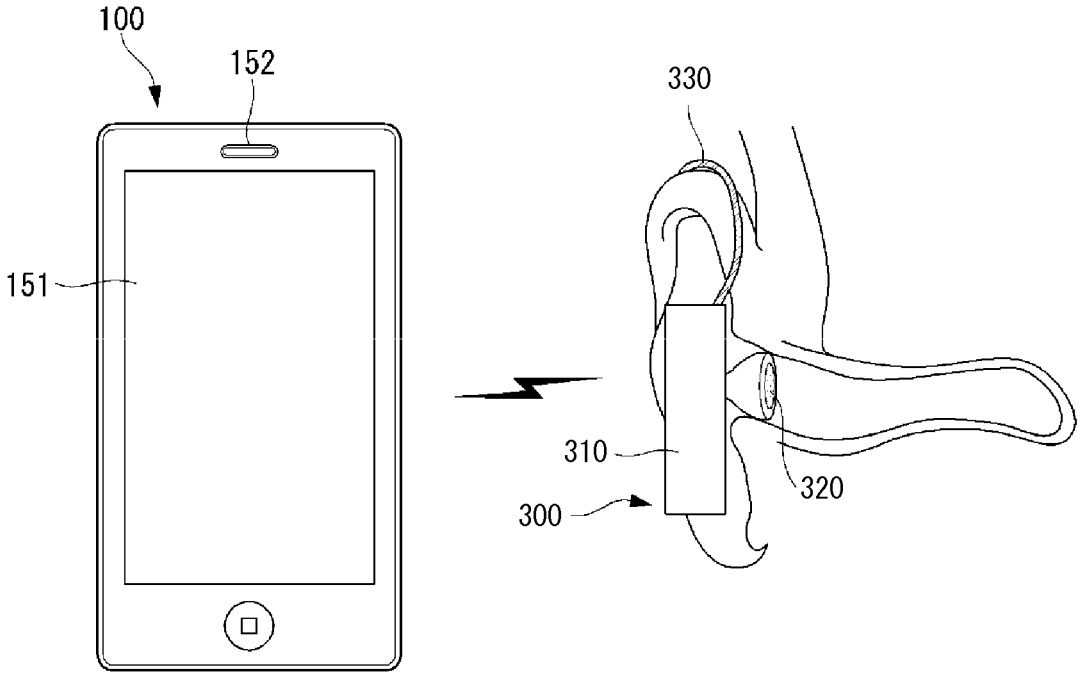
FIGS. 12 and 13 are diagrams illustrating a method for controlling an electronic device according to a third embodiment.
Figure 13:
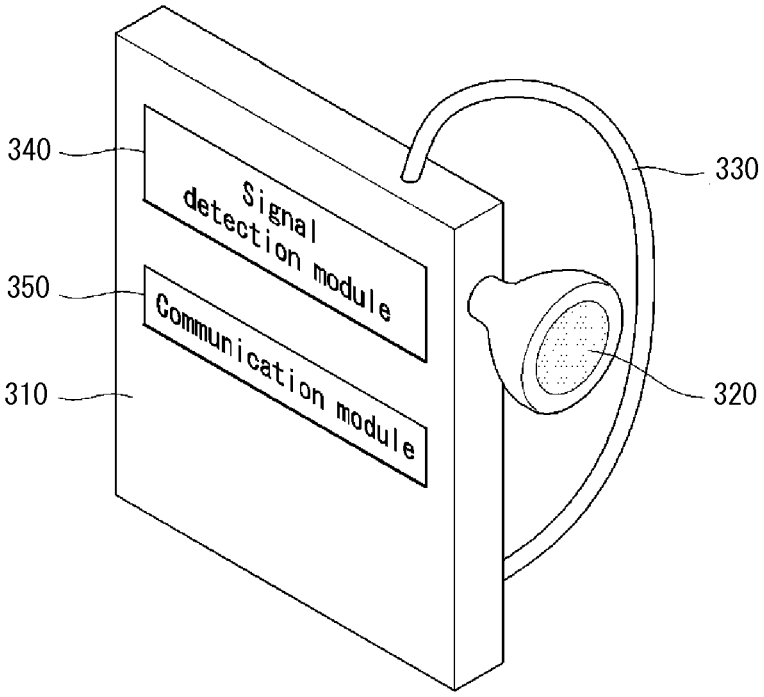

FIG. 11 is a flowchart illustrating a method for controlling an electronic device according to a third embodiment, and FIGS. 12 and 13 are diagrams illustrating a method for controlling an electronic device according to a third embodiment.

According to the third embodiment, the controller 180 of FIG. 1 forms a communication channel with a wireless earphone (S310). When receiving an electric signal from the wireless earphone (S320), the controller 180 of FIG. 1 may extract magnitude or a frequency of the received electric signal (S330).

The controller 180 of FIG. 1 may compare the detected magnitude or frequency of the electric signal with a reference value (S340), may determine whether the wireless earphone is worn (S350), and may control an output operation of a sound (S360).

According to the third embodiment, what is different from the first and second embodiments is that a signal detection module is a constituent element of the wireless earphone 200.

Referring to FIGS. 12 and 13, the electronic device 100 may form a communication channel with a wireless earphone 300. The wireless earphone 300 includes a body 310, an output unit 320, and a fixing unit 330.

The body 310 of the wireless earphone 300 may include a signal detection module 340 and a controller 350. Further, the body 310 of the wireless earphone 300 may further include a signal generation module to generate a high frequency signal or an ultrasonic signal.

When receiving a control signal regarding an operation mode of the wireless earphone 300 from the controller 180 of the electric device shown in FIG. 1, the wireless earphone 300 may output a sound signal through the wireless earphone according to the control signal or receive a sound signal through the wireless earphone.

The wireless earphone 300 converts the received sound signal into an electric signal and transmits the converted electric signal to the electric device. The controller 180 of the electronic device may determine whether the earphone is worn by analyzing the received electric signal, and may control a sound operation.

A method of determining whether the earphone is worn by analyzing the received electric signal, and a method of controlling a sound operation have been described above.

When receiving the high frequency signal or the ultrasonic signal together with a control signal associated with an operation mode of the wireless earphone 300 from the controller 180 of the electronic device shown in FIG. 1, the wireless earphone 300 may output the high frequency signal or the ultrasonic signal, and may receive an electric signal of a reflective wave.

Furthermore, the wireless earphone 300 may set a function of the controller so that the controller changes an operation state of a wireless earphone according to a control signal received from the electronic device to detect a sound signal.

The present disclosure has been made in an effort to solve problems of known electronic devices having earphones, and an object of the present disclosure is to provide an electronic device to determine whether an earphone is being worn, and to control an operation according to presence of wearing of the earphone.

In order to accomplish the above objects of the present disclosure, there is provided an electronic device including: a signal detection module configured to acquire an electric signal from an earphone plug; and a controller to acquire the electric signal through the signal detection module, to detect magnitude of the acquired electric signal, to determine whether an earphone is worn by comparing a variation amount in the magnitude of the electric signal with a reference value, and to control an output operation of a sound according to whether the earphone is worn.

The controller may be configured to determine that the earphone is worn when the variation amount in the magnitude of the electric signal is equal to or greater than the reference value, and may be configured to determine that the earphone is not worn when the variation amount in the magnitude of the electric signal is less than the reference value.

The controller may be configured to control the sound to be output through the earphone when it is determined that the earphone is worn, and may be configured to control the sound to be output through an external speaker when it is determined that the earphone is not worn.

The signal detection module may be configured to acquire the electric signal separated from a region of the earphone plug corresponding to a left earphone or a region of the earphone plug corresponding to a right earphone.

The controller may be configured to control to reduce a volume of a sound output through a corresponding earphone when one of the left earphone and the right earphone is worn.

The controller may be configured to acquire the electric signal through the signal detection module only when receiving a specific event.

There is provided an electronic device including: a signal detection module configured to acquire an electric signal from an earphone plug; and a controller configured to generate one of a high frequency signal and an ultrasonic signal, to output the generated signal through an earphone, to acquire an electric signal through the signal detection module, to detect a frequency of the acquired electric signal, to determine whether the earphone is worn by comparing the detected frequency of the electric signal with a frequency of the generated signal, and to control an output operation of a sound according to whether the earphone is worn.

The controller may be configured to determine that the earphone is worn when the detected frequency of the electric signal is equal to the frequency of the generated signal, and may be configured to determine that the earphone is not worn when the detected frequency of the electric signal is less than the frequency of the generated signal.

The controller may be configured to output the generated signal when a specific event occurs or only during a preset period, and may be configured to acquire the electric signal through the signal detection module.

There is provided an electronic device including: a communication unit; and a controller configured to receive an electric signal from a wireless earphone through the communication unit, to detect magnitude or a frequency of the electric signal, to determine whether the wireless earphone is worn by comparing a variation amount in the magnitude of the electric signal or the frequency of the electric signal with a reference value, and to control an output operation of a sound according to whether the wireless earphone is worn.

The controller may be configured to generate at least one of a high frequency signal or an ultrasonic signal, and be configured to control to transmit the generated signal to the wireless earphone through the communication unit so that the generated signal is output through the wireless earphone.

The controller may be configured to generate and output at least one of a high frequency signal or an ultrasonic signal from the wireless earphone, and be configured to acquire and convert a reflective wave with respect to the output signal into an electric signal, and be configured to control the wireless earphone to transmit the electric signal.

The controller may be configured to transmit a control to request acquisition of the electric signal to the wireless earphone when receiving a specific event.

There is provided a method for controlling an electronic device, the method including: acquiring an electric signal from an earphone plug; detecting magnitude of the acquired electric signal; determining whether an earphone is worn by comparing a variation amount in the detected magnitude of the electric signal with a reference value; and controlling an output operation of a sound according to whether the earphone is worn.

There is provided a method for controlling an electronic device, the method including: generating one of a high frequency signal or an ultrasonic signal to output the generated signal through an earphone; acquiring an electric signal from the earphone plug of the earphone; detecting a frequency of the acquired electric signal; determining whether the earphone is worn by comparing the detected frequency with a frequency of the generated signal; and controlling an output operation of a sound according to whether the earphone is worn.

There is provided a method for controlling an electronic device, the method including: forming a communication channel with a wireless earphone; receiving an electric signal from the wireless earphone; detecting magnitude or a frequency of the received electric signal; determining whether the wireless earphone is worn by comparing a variation amount in the detected magnitude of the electric signal or the frequency of the electric signal; and controlling an output operation of a sound according to whether the wireless earphone is worn.

The details of other embodiments are contained in the detailed description and accompanying drawings.

According to embodiments of the present disclosure, since presence of wearing the earphone may be determined by detecting an electric signal from an earphone plug, the present disclosure is flexibly applicable to an earphone according to the related art without an additional configuration.

Further, according to embodiments of the present disclosure, when a specific sound signal is output through an earphone as well as when the sound signal is not output, the present disclosure may determine whether to wear the earphone using a high frequency signal or a ultrasonic signal.

Moreover, since embodiments of the present disclosure may set to determine presence of wearing the earphone only when a specific event is generated, power consumption can be reduced.

In addition, embodiments of the present disclosure are applicable to a wireless earphone as well as a wired earphone by inserting a simple circuit capable of detecting an electric signal of the wireless earphone.

According to the embodiments of the present disclosure, it can be easily determined whether the earphone is worn without adding a new configuration in an earphone according to the related art or by inserting only a simple signal detection circuit.

The above-described method of controlling the electronic device may be written as computer programs and may be implemented in digital microprocessors that execute the programs using a computer readable recording medium. The method of controlling the electronic device may be executed through software. The software may include code segments that perform required tasks. Programs or code segments may also be stored in a processor readable medium or may be transmitted according to a computer data signal combined with a carrier through a transmission medium or communication network.

The computer readable recording medium may be any data storage device that can store data that can be thereafter read by a computer system. Examples of the computer readable recording medium may include read-only memory (ROM), random-access memory (RAM), CD-ROMs, DVD±ROM, DVD-RAM, magnetic tapes, floppy disks, and optical data storage devices. The computer readable recording medium may also be distributed over network coupled computer systems so that the computer readable code is stored and executed in a distribution fashion.

An electronic device may include a first touch screen configured to display a first object, a second touch screen configured to display a second object, and a controller configured to receive a first touch input applied to the first object and to link the first object to a function corresponding to the second object when receiving a second touch input applied to the second object while the first touch input is maintained.

A method may be provided of controlling a electronic device that includes displaying a first object on the first touch screen, displaying a second object on the second touch screen, receiving a first touch input applied to the first object, and linking the first object to a function corresponding to the second object when a second touch input applied to the second object is received while the first touch input is maintained.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electronic device comprising:

a speaker;

an interface to connect to an earphone;

a signal detection module configured to detect an electric signal from the earphone through the interface; and a controller configured to determine whether the earphone is worn by a user based on the detected electric signal, wherein the electric signal is acquired through the signal detection module, a magnitude of the acquired electric signal is determined, whether the earphone is worn by the user is determined based on a difference between the magnitude of the electric signal and a reference value, and the speaker and the earphone are controlled for outputting sound according to whether the earphone is worn by the user, wherein the controller is configured to determine whether each of a left earphone and a right earphone are being worn, and to reduce a volume through the left or the right earphone that is determined to be worn when only one of the left or the right earphone is being worn.

2. The electronic device of claim 1, wherein the earphone is determined to be worn when the magnitude of the electric signal is equal to or greater than the reference value, and the earphone is determined to be not worn when the magnitude of the electric signal is less than the reference value.

3. The electronic device of claim 1, wherein the controller is configured to control the sound to be output through the earphone when it is determined that the earphone is worn, and is configured to control the sound to be output through the speaker when it is determined that the earphone is not worn, in a state where the earphone is connected to the interface.

4. The electronic device of claim 3, wherein the sound is a ring tone for an incoming call, and the ring tone for the incoming call is output through the speaker while the headphone is connected to the interface when it is determined that the earphone is not being worn by the user.

5. The electronic device of claim 1, wherein the interface is a wireless interface configured to wirelessly connect to the earphone.

6. The electronic device of claim 1, wherein the interface is an earphone jack configured to connect to a plug on the earphone.

7. The electronic device of claim 6, wherein the signal detection module is configured to acquire the electric signal from a first region of the earphone plug corresponding to the left earphone or a second region of the earphone plug corresponding to the right earphone.

8. The electronic device of claim 1, wherein the controller is configured to acquire the electric signal through the signal detection module in order to determine whether the earphone is being worn by a user only in response to a prescribed event.

9. An electronic device comprising:

a signal detection module configured to acquire an electric signal through an earphone jack; and a controller configured to generate one of a high frequency signal or an ultrasonic signal, to output the generated signal through an earphone, to acquire the electric signal through the signal detection module, to detect a frequency of the acquired electric signal, to determine whether the earphone is worn by a user by comparing the detected frequency of the electric signal with a frequency of the generated signal, and to control whether sound is output through the earphone according to whether the earphone is worn.

10. The electronic device of claim 9, wherein the controller is configured to determine that the earphone is worn when the detected frequency of the electric signal is equal to the frequency of the generated signal, and is configured to determine that the earphone is not worn when the detected frequency of the electric signal is less than the frequency of the generated signal.

11. The electronic device of claim 9, wherein the controller is configured to output the generated signal in response to a prescribed event or during a prescribed period of time, and is configured to acquire the electric signal through the signal detection module based on the output generated signal.

12. An electronic device comprising:

a communication unit configured to communicatively connect to a wireless earphone; and a controller configured to receive an electric signal from the wireless earphone through the communication unit, to detect a magnitude or a frequency of the electric signal, to determine whether the wireless earphone is worn by a user by comparing the magnitude of the electric signal or the frequency of the electric signal with a reference value, and to control output of sound according to whether the wireless earphone is worn, wherein the controller is configured to generate and output at least one of a high frequency signal or an ultrasonic signal from the wireless earphone, to acquire and convert a reflective wave with respect to the output signal into an electric signal, and to control the wireless earphone to transmit the electric signal.

13. The electronic device of claim 12, wherein the controller is configured to generate at least one of a high frequency signal or an ultrasonic signal, and controls to transmit the generated signal to the wireless earphone through the communication unit so that the generated signal is output through the wireless earphone.

14. The electronic device of claim 12, wherein the controller is configured to transmit a request to the wireless earphone to acquire the electric signal in response to a prescribed event.

15. The electronic device of claim 12, wherein, in a state in which the wireless earphone is communicatively connected to the communication unit, the controller controls to output sound through a speaker on the electronic device when it is determined that the wireless earphone is not being worn by a user.

16. A method for controlling an electronic device, comprising:

acquiring an electric signal through an earphone jack;

detecting a magnitude of the acquired electric signal;

determining whether an earphone is worn by a user based on a difference between the magnitude of the electric signal and a reference value;

controlling an output of sound through a speaker or the earphone according to whether the earphone is worn by the user;

determining whether each of a left earphone and a right earphone are being worn; and reducing a volume through the left or the right earphone that is determined to be worn when only one of the left or the right earphone is being worn.

17. A method for controlling an electronic device, comprising:

generating one of a high frequency signal or an ultrasonic signal;

outputting the generated signal through an earphone;

acquiring an electric signal from the earphone through the earphone jack;

detecting a frequency of the acquired electric signal;

determining whether the earphone is worn by a user by comparing the detected frequency of the electric signal with a frequency of the generated signal; and controlling whether sound is output through the earphone according to whether the earphone is worn.

18. A method for controlling an electronic device, comprising:

establishing a communication channel with a wireless earphone;

generating and outputting at least one of a high frequency signal or an ultrasonic signal from the wireless earphone;

acquiring and converting a reflective wave with respect to the output signal into an electric signal; and controlling the wireless earphone to transmit an electric signal;

determining whether the wireless earphone is worn by a user by comparing the magnitude of the electric signal or the frequency of the electric signal; and controlling an output of a sound according to whether the wireless earphone is worn.

* * * * *